US010718306B2

(12) United States Patent
Saathoff et al.

(10) Patent No.: US 10,718,306 B2
(45) Date of Patent: Jul. 21, 2020

(54) STARTER MOTOR ASSISTANCE APPARATUS

(71) Applicant: DENSO International America, Inc., Southfield, MI (US)

(72) Inventors: Scott Saathoff, Livonia, MI (US); Ilco Eli Aksovski, Macomb, MI (US)

(73) Assignee: DENSO INTERNATIONAL AMERICA, INC., Southfield, MI (US)

( * ) Notice: Subject to any disclaimer, the term of this patent is extended or adjusted under 35 U.S.C. 154(b) by 156 days.

(21) Appl. No.: 16/137,644

(22) Filed: Sep. 21, 2018

(65) Prior Publication Data

US 2020/0095967 A1 Mar. 26, 2020

(51) Int. Cl.

| | |
|---|---|
| ***F02N 11/08*** | (2006.01) |
| ***F02N 15/10*** | (2006.01) |
| ***F02N 19/00*** | (2010.01) |
| ***F02N 11/10*** | (2006.01) |

(52) U.S. Cl.

CPC ..... *F02N 11/08* (2013.01); *F02N 11/0803* (2013.01); *F02N 11/0848* (2013.01); *F02N 11/0851* (2013.01); *F02N 11/10* (2013.01); *F02N 15/10* (2013.01); *F02N 19/00* (2013.01); *F02N 19/001* (2013.01); *F02N 2200/046* (2013.01)

(58) Field of Classification Search

CPC ..... F02N 11/00; F02N 11/08; F02N 11/0803; F02N 11/006; F02N 11/02; F02N 11/0807; F02N 11/0848; F02N 11/0851; F02N 11/087; F02N 11/10; F02N 11/14; F02N 15/10; F02N 19/00; F02N 19/001; F02N 2200/046

USPC ..... 123/179.1, 179.2, 179.3, 179.24

See application file for complete search history.

(56) References Cited

U.S. PATENT DOCUMENTS

| | | | | |
|---|---|---|---|---|
| 9,359,988 | B2 | 6/2016 | McNabb | |
| 10,337,438 | B2 * | 7/2019 | Jiang | F02N 11/0803 |
| 2010/0175656 | A1 * | 7/2010 | Doub | H02J 7/1461 123/179.3 |
| 2014/0032037 | A1 * | 1/2014 | Lott | F02N 11/108 701/29.2 |
| 2015/0300308 | A1 * | 10/2015 | Mori | B60L 50/16 701/22 |
| 2018/0335007 | A1 * | 11/2018 | Shields | B60W 20/50 |

FOREIGN PATENT DOCUMENTS

| | | | |
|---|---|---|---|
| DE | 3916936 | A1 | 11/1990 |
| JP | H09166069 | A | 6/1997 |
| JP | 2015165115 | A | 9/2015 |

* cited by examiner

*Primary Examiner* — Erick R Solis

(74) *Attorney, Agent, or Firm* — Brooks Kushman, P.C.

(57) ABSTRACT

A starter motor assist mechanism is provided. The starter motor assist mechanism may include a housing, a solenoid, and a hammer. The housing may be attachable to a starter motor. The solenoid may be disposed within the housing, and the hammer may be connected to the solenoid. The solenoid may move the hammer from a retracted position to an extended position for striking the starter motor.

20 Claims, 5 Drawing Sheets

STARTER MOTOR ASSISTANCE APPARATUS

TECHNICAL FIELD

The present disclosure relates to electric motors for automotive vehicles, in particular starter motors for starting an internal combustion engine.

BACKGROUND

Vehicles equipped with internal combustion engines include an electric starter that is operable to start the engine. Electric starters may be electro-mechanical, in that they may include an electric motor that receives current from a battery to cause a mechanical output, e.g., rotating a gear to crank the engine. For various reasons, the starter motor may not crank the engine because the electric motor, the gear, or both may not rotate.

SUMMARY

According to one embodiment, a starter motor assist mechanism is provided. The starter motor assist mechanism may include a housing, a solenoid, and a hammer. The housing may be attachable to a starter motor. The solenoid may be disposed within the housing, and the hammer may be connected to the solenoid. The solenoid may move the hammer from a retracted position to an extended position for striking the starter motor.

According to another embodiment, a vehicle starting system is provided. The vehicle starting system may include a starter motor that includes a casing defining a yoke that surrounds an armature. The starter motor may be configured to engage and start an engine. The vehicle starting system may also include a starter-assist device that may be mounted to the casing of the starter motor. The starter-assist device may include a housing, a solenoid that may be disposed within the housing, and a hammer that may be operatively connected to the solenoid. When the solenoid is powered, the hammer may move from a retracted position to an extended position to strike the yoke.

According to yet another embodiment, a starter-motor-assist system is provided. The starter-motor-assist system may include a starter motor, a first solenoid, a starter-assist mechanism, and a controller. The starter motor may be configured to rotate and start an engine. The starter motor may include a casing that surrounds an armature of the starter motor. The first solenoid may be mechanically connected to the starter motor and configured to close a set of contacts to provide power to the starter motor. The starter-assist mechanism may include a second solenoid and a hammer that may be operatively coupled to the second solenoid. The hammer may be moveable from a retracted position to an extended position to strike the casing. The controller may be configured to, responsive to the first solenoid closing the set of contacts and the starter motor not rotating, send a signal to provide power to the second solenoid so that the hammer strikes the casing to facilitate rotation of the starter motor.

BRIEF DESCRIPTION OF THE DRAWINGS

FIG. 2-A is a cross-sectional view of the starter-assist mechanism.

DETAILED DESCRIPTION

Figure 1:
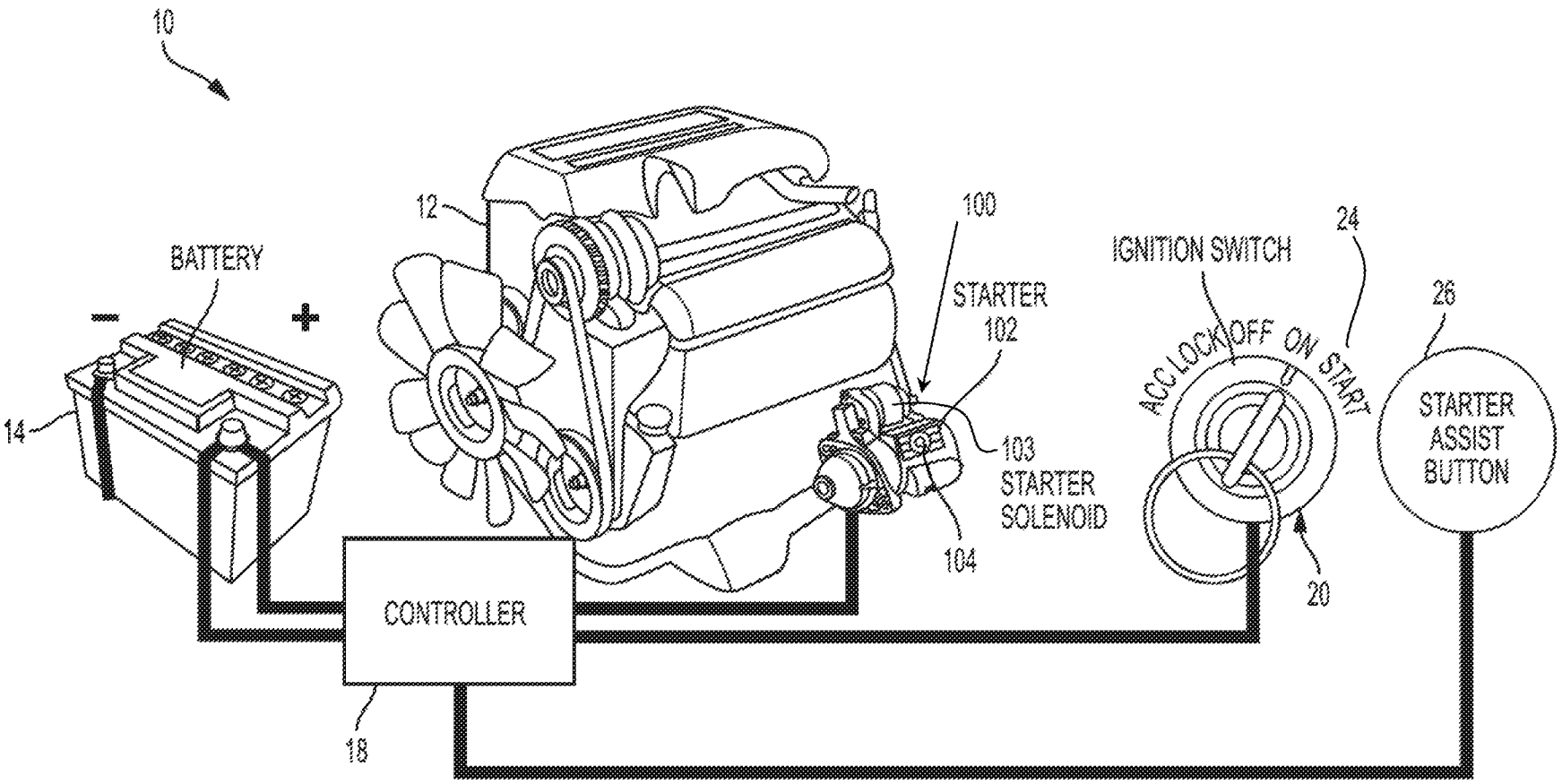
FIG. 1 is a perspective view of an exemplary vehicle starting system.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Internal combustion engines generally include an electric starter motor that includes a rotating gear used to rotate (crank) the internal-combustion engine to initiate the engine's operation under its own power. Generally, starter motors include an armature that rotates in response to an electric current provided through an adjacent electric field coil. The starter motor may include a solenoid that provides electric current to the field coil. The armature may be coupled to a shaft that includes a drive gear. The drive gear may engage one or more gears so that rotation of the drive gear causes rotation of a pinion gear. In some electric motors, one or more gears may translate or slide in a longitudinal direction so that the pinion gear engages the engine.

Under certain circumstances, the armature may not rotate, or the shaft may not translate (e.g., axial or linearly), thus causing a no-start condition. As one example, one or more brushes within the electric motor may stick, thus causing a stuck brush condition, and preventing rotation of the armature. A stuck brush may be due to carbon build up, oxidation, corrosion, or some combination thereof. As another example, corrosion of the starter housing or one or more internal components may cause an accumulation of rust or debris within the casing. This debris may prevent rotation of the electric motor, one or more of the gears, or translation of one or more of the shafts of the motor. Striking the housing of the starter motor with a tool, e.g., hammer, wrench, or other blunt instrument may dislodge the debris or dislodge a stuck brush. While this resolves the issue, the operator of the vehicle may be required to tow it to a vehicle service provider so that the condition is resolved, either by replacement of the starter motor or the method described above. Alternatively, the operator may be forced to exit the vehicle, locate the starter motor by crawling underneath the vehicle, and hit or strike the starter motor as described above. This disclosure attempts to provide an alternative solution to the above-mentioned problems.

Referring to FIG. 1, a perspective view of a vehicle starting system 10 is provided. The vehicle starting system 10 may include an engine 12 that may be cranked by a starter motor assembly 100. The engine 12 may be started by or in response to switching an ignition switch 20 to a start position 24. The starter motor assembly 100 may include a starter motor 102 that may receive electric current from a battery 14, through a starter solenoid 103. The starter motor assembly 100 includes a starter-assist mechanism 104 that may be employed in the event of a no-start condition. As will be described in greater detail below, the vehicle starting system 10 may also include a controller 18 and associated logic that sends and receives signals to control the components described above.

In one embodiment, the controller 18 may be configured to send a signal to power the starter-assist mechanism 104 in response to the ignition switch 20 being in the start position 24 and the presence of a no-start condition.

In another embodiment, a starter-assist button 26 may be provided. The starter-assist button 26 may be actuated so that power is provided and the starter-assist mechanism 104 is actuated.

Figure 2:
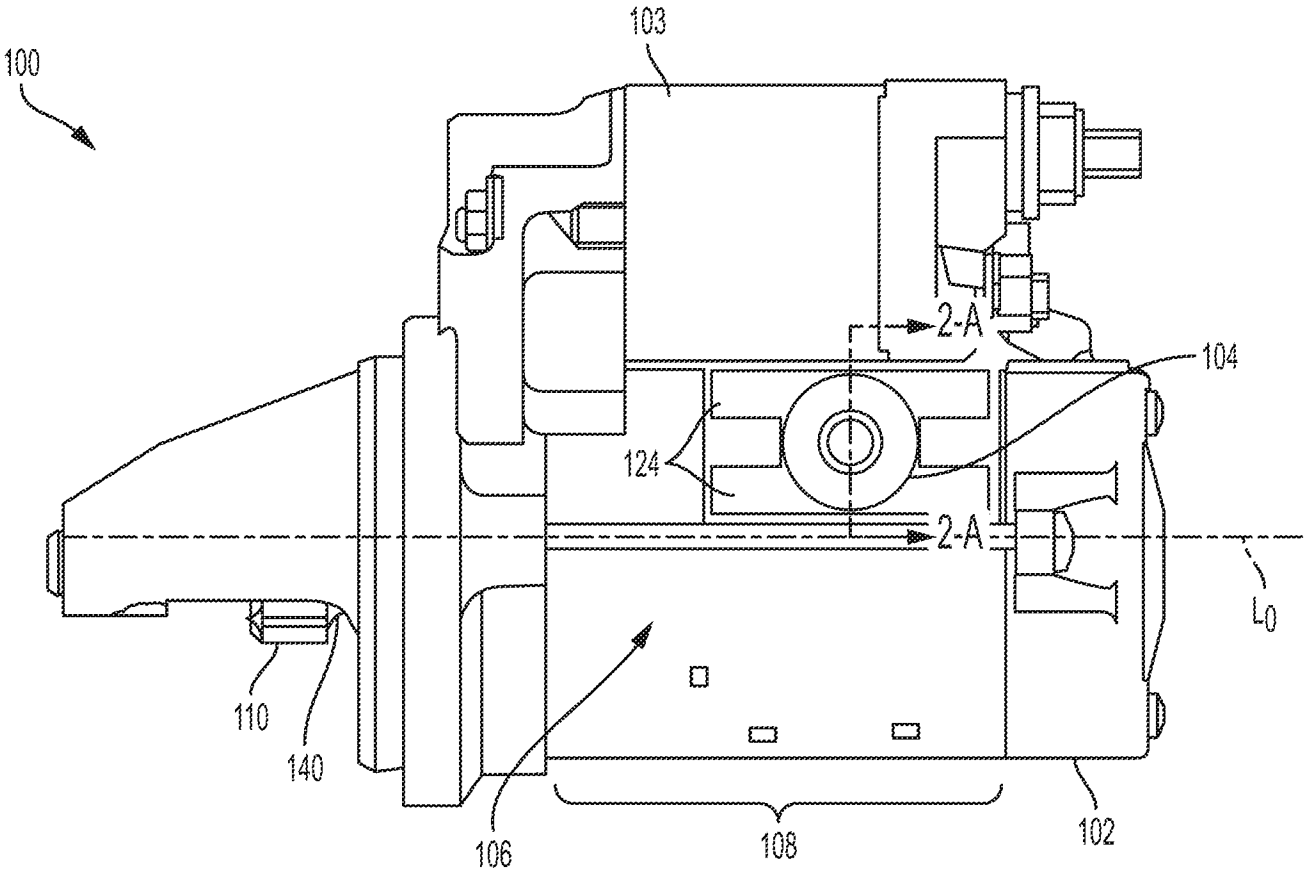
FIG. 2 is a side view of an exemplary starter motor assembly and a starter-assist mechanism.
Figure 3:
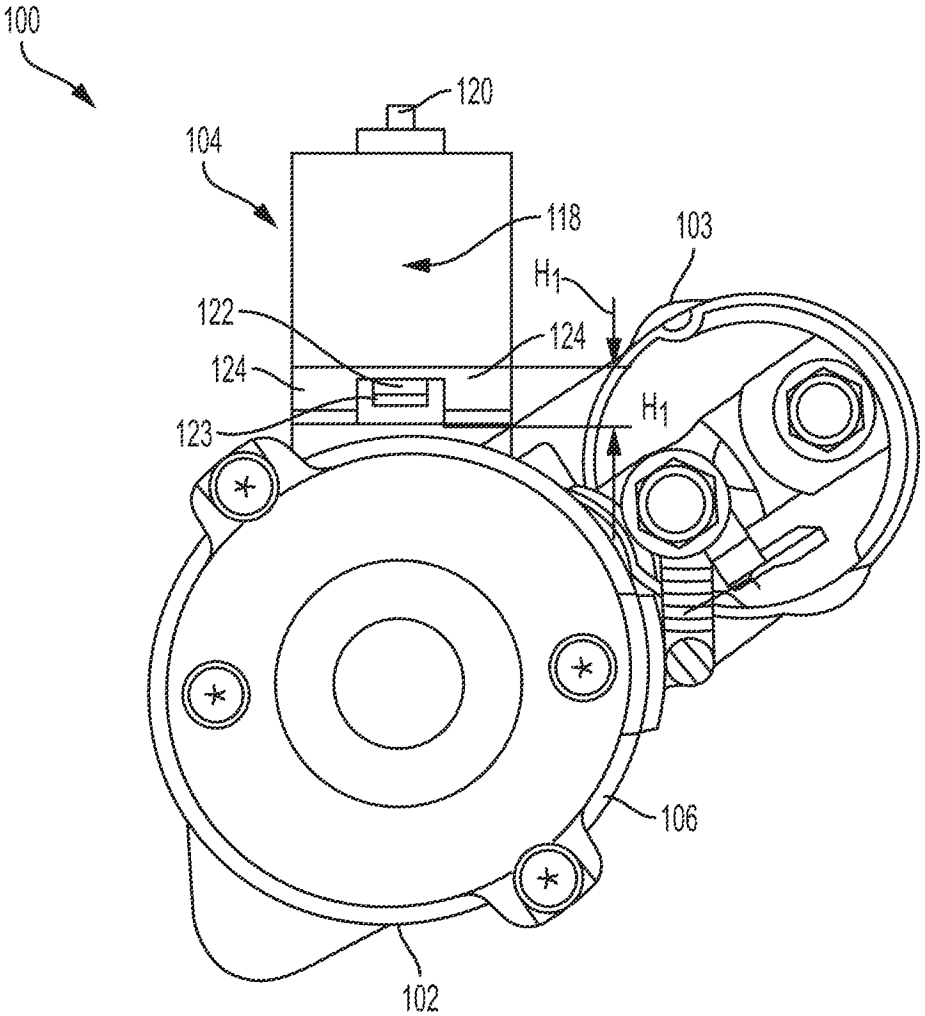
FIG. 3 is a rear view of the starter motor assembly and the starter-assist mechanism.

As shown in FIGS. 2 and 3, the starter motor 102 may include a starter casing 106 that encloses or surrounds the internal components of the starter motor. The starter-assist mechanism 104 may be mounted or attached to a yoke region 108 of the starter motor 102. The yoke region 108 refers to the portion of the casing 106 that houses the armature, field windings, and a rotatable shaft (not illustrated) connected to a pinion gear 110. The starter motor 102 may define a longitudinal axis $L_0$ and the armature, shaft, and pinion gear 110 may rotate about the longitudinal axis $L_0$. The longitudinal axis $L_0$ may also be referred to as an axis of rotation. Note the internal components of the starter motor 102 are not illustrated, one skilled in the art would appreciate that the armature, field windings, and a rotatable shaft are generally used in starter motors.

Figure 2A:
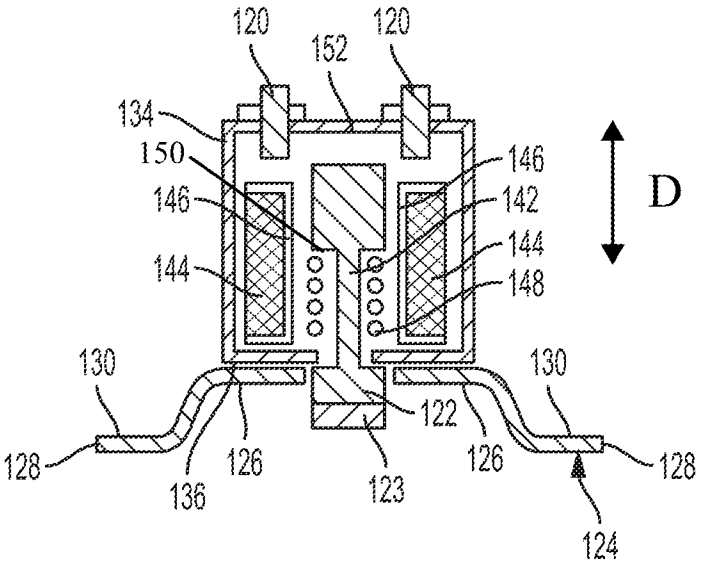

The starter-assist mechanism 104 may include a starter-assist solenoid 118 that is provided with terminals 120 that may be electrically connected (e.g., directly or indirectly) to the battery 14. A hammer 122 may be coupled to the starter-assist solenoid 118 so that it is moveable from a retracted position to an extended position, along the bi-directional arrow D (FIG. 2A). In the extended position, the hammer 122 strikes or hits the starter casing 106. In at least one embodiment, the hammer is in a direction that is orthogonal to the longitudinal axis $L_0$. The term orthogonal means intersecting or lying along a right angle.

The hammer 122 may strike or hit the starter casing with a predetermined force ranging between 50 N and 500 N. The predetermined force may depend on one of several factors, including but not limited to, the size, shape, thickness, and material type of the starter casing 106. For example, larger engines for trucks and the like require larger starter motors and in turn, larger casings, whereas starter motors for smaller passenger cars may include smaller starter motors and smaller starter casings. More force may be required for the larger starter motors than those starter motors for smaller vehicles. The predetermined force may be selected for the size and shape of the starter motor. Another determining factor of the predetermined force may be the expected amount of corrosion or deterioration of the starter casing and the internal components housed therein.

In addition to the force applied by the hammer, the frequency of the strikes made by the hammer 122 may be altered by the controller 18. Frequency refers to the number of movements occurring with a fixed period and may be described in hertz (Hz). The frequency of the strikes may range between a relatively low frequency, such as 1 Hz, to an ultrasonic frequency, such as 20,000 Hz. Increasing the frequency of the strikes may create one or more vibrations through starter motor 102, which may loosen or dislodge a stuck brush or debris more effectively than a lower frequency.

The starter casing 106 may be made of a stamping comprised of one or more materials (e.g., steel, aluminum, an alloy, or other suitable materials). Due to fuel efficiency and emissions concerns, the thickness of the starter casing may be kept to a minimum to conserve weight. To prevent damage to the casing 106, such as denting or fractures, the hammer 122 may include a dampening member 123 that acts as a barrier between the hammer and the starter casing 106. The dampening member 123 may be comprised of an elastomeric material, such as rubber or a polymeric material, that is adhered to the hammer 122. Alternatively, the dampening member 123 may be over-molded over the hammer 122.

A mounting bracket 124 may be attached to the starter-assist solenoid 118 and the starter casing 106. The mounting bracket 124 may have a medial portion 126 and attachment portions 128 that are spaced apart from the medial portion 126 so that the starter-assist solenoid is spaced apart from the starter casing 106 by a distance Hi. The attachment portions 128 of the mounting bracket 124 may define attachment apertures 130 through which a fastener may extend to engage the starter casing 106.

Referring specifically to FIG. 2A, a cross-sectional view of the starter-assist mechanism 104 is provided. The starter-assist solenoid 118 may include a housing 134 that may be attached to the medial portion 126 of the mounting bracket 124. A bottom portion 136 of the housing 134 may define an opening, such as an aperture. The hammer 122 may be connected to an end of a plunger 142 that may translate through the aperture. The plunger 142 may be comprised of a magnetic material so that an electromagnetic force may act upon the plunger 142 in response to an electric current flowing through adjacent coils 144 that may be positioned on a bobbin 146 that surrounds the plunger 142.

The electromagnetic force acting upon the plunger 142 causes the plunger 142 and the hammer 122 to move or translate from the retracted position to the extended position. In the retracted position, the hammer 122 may be adjacent to the bottom portion 136 of the housing 134. In the extended position, the hammer 122 contacts with starter casing 106. A return spring 148 may bias or return the hammer 122 from the extended position to the retracted position when the solenoid 118 is deactivated or when a force applied by the return spring 148 is greater than the force applied by the solenoid 118. The return spring 148 may be disposed between the bottom portion 136 of the housing 134 and a bottom portion 150 of the plunger 142, as shown. Alternatively, the return spring 148 may be positioned against a top portion 152 of the housing 134 and the other end may be engaged or attached to the plunger 142.

In one or more embodiments, the starter-assist mechanism 104 may be connected to or attached to the starter solenoid 103. Under certain circumstances, the starter solenoid 103 may not be electrically connected to the starter motor 102. For example, debris (e.g., ice or solid corrosion) may be disposed on the contacts of the starter solenoid 103, thus preventing a flow of current from the starter solenoid 103 to the starter motor 102. The starter-assist mechanism 104 may then be actuated so that the hammer 122 strikes the starter solenoid 103 to displace the debris from the contacts of the starter solenoid 103.

Figure 4:
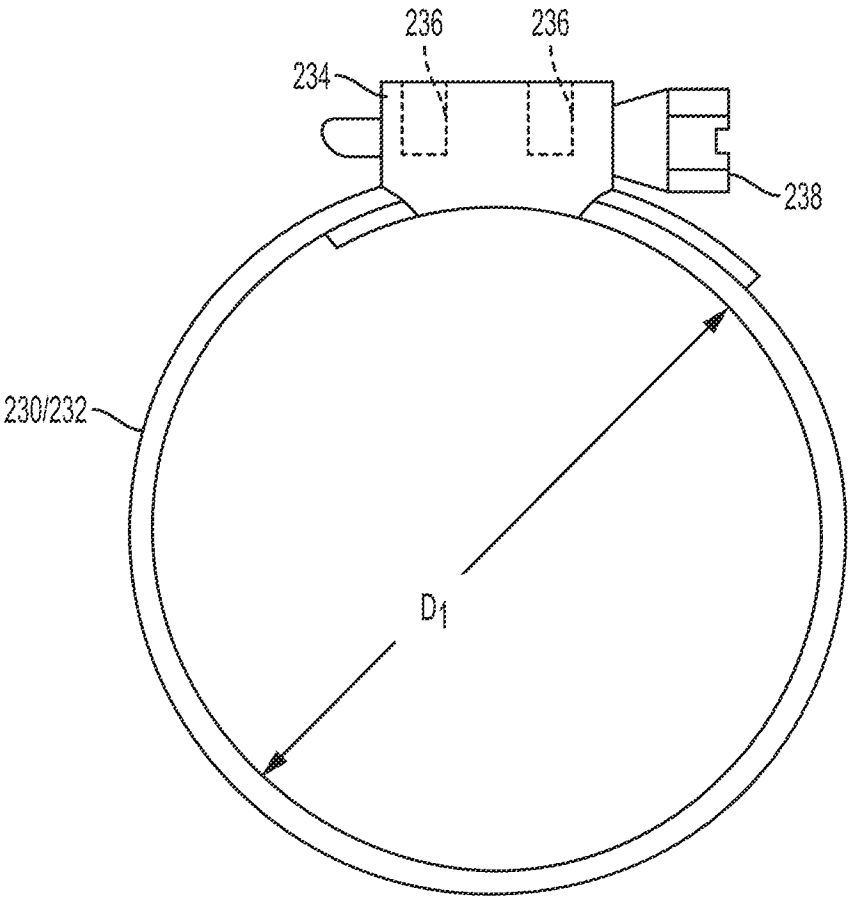
FIG. 4 is a perspective view of exemplary attachment members.

In another embodiment, straps 230 or clamps 232 may attach the mounting bracket 124 to the casing 106 of the starter motor 102, as shown in FIG. 4. The straps 230 or clamp 232 may be inserted through an adjustable mount 234. A fastener 238 may be threaded into the adjustable mount 234. The fastener may be rotated to move one portion of the strap 230 or clamp 232 with respect to another portion of the strap 230 or clamp 232. Moving one portion of the strap 230 or clamp 232 with respect to the other portion may increase or decrease the inner diameter $D_1$. Because the inner diameter $D_1$ is adjustable, the straps 230 or clamps 232 facilitate attaching the starter-assist mechanism 104 to various sized starter motors. The adjustable mount 234 may include fastener apertures 236 that may receive one or more fasteners for attaching the attachment portions 128 of the mounting bracket 124 to the adjustable mount 234.

Figure 5:
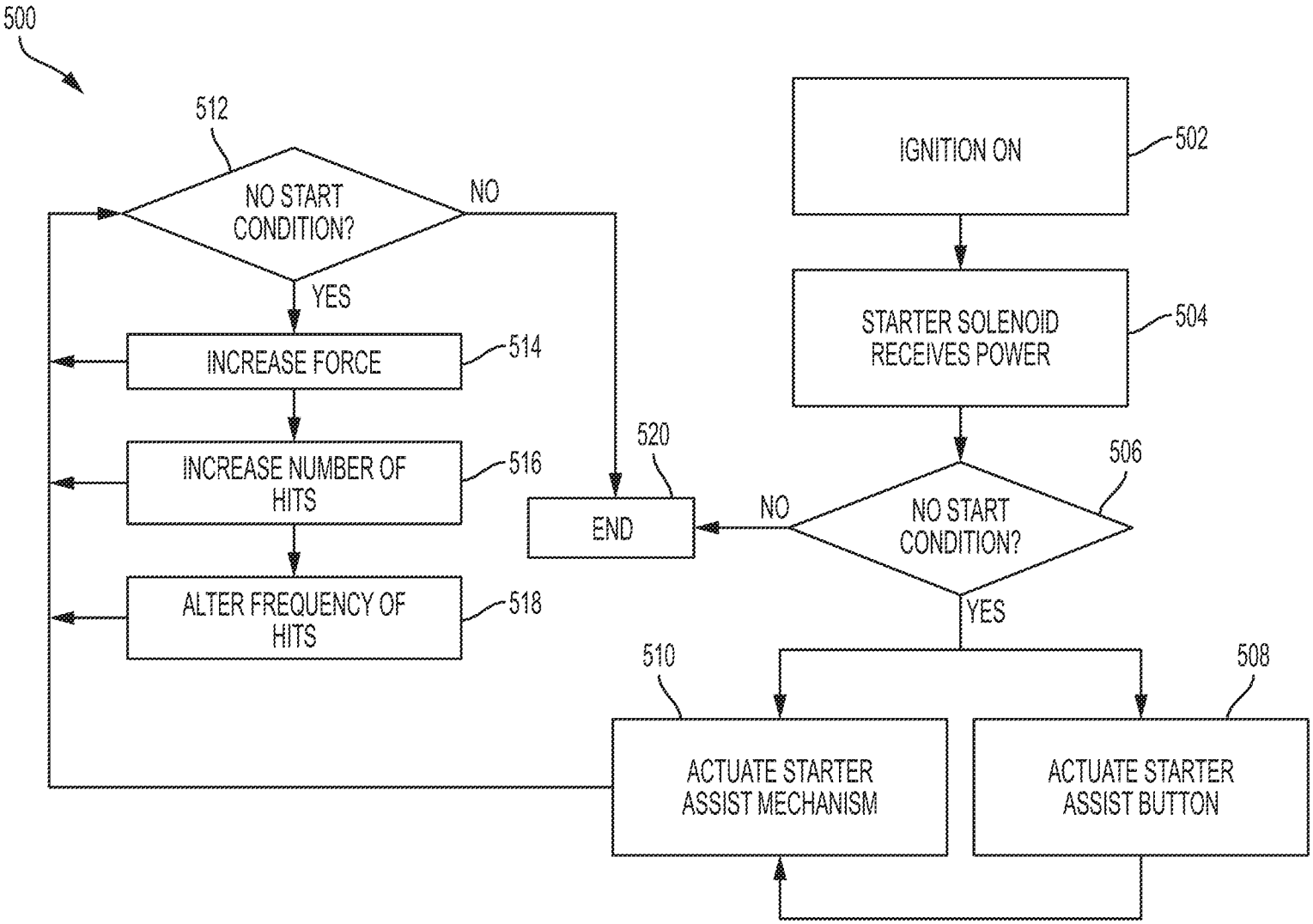
FIG. 5 is a flowchart of an exemplary method of operating the vehicle starting system.

Control logic or functions performed by the controller 18 may be represented by flow charts or similar diagrams, such as the flow chart 500 in FIG. 5. FIG. 5 provides a representative control strategy and/or logic that may be implemented using one or more processing strategies such as polling, event-driven, interrupt-driven, multi-tasking, multi-threading, and the like. As such, various steps or functions illustrated may be performed in the sequence illustrated, in parallel, or in some cases omitted.

The controller 18 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the starter-assist mechanism 104 and starter motor 102.

Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-controlled vehicle, engine, and/or powertrain controller, such as controller 18.

Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of several known physical devices that utilize electric, magnetic, and/or optical storage to keep executable instructions and associated calibration information, operating variables, and the like.

In operation 502, the ignition switch 20 is placed in the start position 24 so that electric current is provided from the battery 14 to the starter solenoid 103, as represented by operation 504. If the starter motor 102 actuates and cranks the engine 12, the process ends at operation 520. On the other hand, if the starter motor 102 does not actuate and a no-start condition occurs, the controller 18 may provide a signal to actuate the starter-assist mechanism 104, as represented by operation 510.

Alternatively, the controller may not be programmed to actuate the starter-assist mechanism 104, and an operator of the vehicle may actuate the starter-assist button 26, as represented by operation 508. Actuating the starter-assist button may send a signal to the controller 18 to actuate the starter-assist mechanism 104, as represented again by operation 510. In operation 510, the starter-assist mechanism is powered and translates the hammer 122 to strike the starter casing 106 one or more times at a predetermined force and at a predetermined frequency. The predetermined frequency refers to the number of times the hammer is moved from the retracted position to the extended position with respect to a predetermined period. The term predetermined period means a fixed set of time.

After operation 510, the controller 18 may branch to determine or detect whether a second no-start condition occurs, as represented by operation 512. If the engine starter motor actuates, the process ends at 520. If the starter motor has not actuated, the controller may branch to operation 514 to increase the force applied by the hammer 122 to the starter casing 106. In addition to or in lieu of increasing the force applied by the hammer, the controller may also increase number of hits, as represented by operation 516. Moreover, the frequency of the hits may be altered (e.g., increased or decreased) at operation 518.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A starter-motor-assist mechanism comprising:

a housing attachable to a starter motor;

a solenoid disposed within the housing; and a hammer connected to the solenoid, wherein the solenoid moves the hammer from a retracted position to an extended position for striking the starter motor.

2. The starter-motor-assist mechanism of claim 1, wherein the starter motor includes a rotating shaft that rotates about an axis of rotation and wherein the hammer moves from the retracted position to the extended position along a direction that is transverse to the axis of rotation.

3. The starter-motor-assist mechanism of claim 2, wherein the hammer includes a contact surface that is arranged parallel to the axis of rotation.

4. The starter-motor-assist mechanism of claim 1, further comprising a controller configured to send signals to activate and deactivate the solenoid, wherein when the solenoid is activated the hammer is moved to the extended position and wherein when the solenoid is deactivated the hammer is returned to the retracted position.

5. The starter-motor-assist mechanism of claim 4, further comprising a return spring disposed between the housing and the hammer and configured to bias the hammer to the retracted position.

6. The starter-motor-assist mechanism of claim 5, wherein the controller is further configured to alternate the signals at a predetermined frequency over a predetermined period.

7. The starter-motor-assist mechanism of claim 5, wherein the controller is further configured to alter power provided to the solenoid to alter force applied by the hammer.

8. The starter-motor-assist mechanism of claim 1, further comprising a U-Shaped mounting bracket that includes a medial portion and a pair of arms extending therefrom that include attachment portions spaced apart from the medial portion.

9. The starter-motor-assist mechanism of claim 1, further comprising a dampening member attached to the hammer and configured to engage the starter motor.

10. A vehicle starting system comprising:

a starter motor, provided with a casing defining a yoke that surrounds an armature, configured to engage and start an engine; and a starter-assist device, mounted on the casing, including, a housing, a solenoid disposed within the housing, and a hammer operatively connected to the solenoid, wherein when the solenoid is powered, the hammer moves from a retracted position to an extended position to strike the casing.

11. The vehicle starting system of claim 10, wherein the hammer is positioned adjacent to the yoke of the starter motor.

12. The vehicle starting system of claim 10, further comprising a controller configured to, responsive to the starter motor receiving power and the starter motor failing to start the engine, send a signal to provide power and cease power to the solenoid.

13. The vehicle starting system of claim 12, further comprising a starter-assist button, wherein the controller is further configured to send a signal to power the solenoid in response to actuation of the starter-assist button.

14. The vehicle starting system of claim 10, further comprising a dampening member attached to the hammer to form an intermediate surface between the hammer and the yoke.

15. A starter-motor-assist system comprising:

a starter motor, including a casing, configured to rotate and start an engine;

a first solenoid mechanically connected to the starter motor and configured to close a set of contacts to provide power to the starter motor;

a starter-assist mechanism including a second solenoid and a hammer operatively coupled to the second solenoid and moveable from a retracted position to an extended position to strike the casing; and a controller configured to, responsive to the first solenoid closing the set of contacts and the starter motor not rotating, send a signal to provide power to the second solenoid so that the hammer strikes the casing to facilitate rotation of the starter motor.

16. The starter-motor-assist system of claim 15, further comprising a starter-assist button, wherein the controller is further configured to send the signal in response to actuation of the starter-assist button.

17. The starter-motor-assist system of claim 15, wherein the controller is further configured to provide and cease power to the second solenoid so that the hammer strikes the starter multiple times over a predetermined period.

18. The starter-motor-assist system of claim 17, wherein the controller is further configured to provide and cease power to the second solenoid at a predetermined frequency.

19. The starter-motor-assist system of claim 18, wherein the predetermined frequency is greater than or equal to 1 Hz.

20. The starter-motor-assist mechanism of claim 15, wherein the starter-assist mechanism is attached to the first solenoid and wherein the controller is further configured to send a signal to provide power to the second solenoid so that the hammer strikes the first solenoid to facilitate electrical contact from the first solenoid to the starter motor.

* * * * *